United States Patent [19]

White et al.

[11] Patent Number: 4,859,905

[45] Date of Patent: Aug. 22, 1989

[54] UNSATURATED VAPOR HIGH PRESSURE SODIUM LAMP GETTER MOUNTING

[75] Inventors: Philip J. White, Monroe, Conn.; John A. Scholz, Danvers; Robert S. White, Beverly, both of Mass.

[73] Assignee: GTE Products Corporation, Danvers, Mass.

[21] Appl. No.: 274,658

[22] Filed: Nov. 21, 1988

Related U.S. Application Data

[63] Continuation of Ser. No. 473,897, Mar. 10, 1983, abandoned.

[51] Int. Cl.[4] ..... H01J 61/26

[52] U.S. Cl. ..... 313/558

[58] Field of Search ..... 313/549, 553, 558, 559, 313/561; 252/181.1, 181.6; 417/48

[56] References Cited

U.S. PATENT DOCUMENTS

| | | | |
|---|---|---|---|
| 3,248,590 | 4/1966 | Schmidt | 313/637 X |
| 3,453,477 | 7/1969 | Hanneman et al. | 313/184 |
| 3,485,343 | 12/1969 | Jorgensen | 313/579 X |
| 3,558,963 | 1/1971 | Hanneman et al. | 313/184 |
| 3,737,710 | 6/1973 | Waymouth et al. | 313/553 |
| 4,075,530 | 2/1978 | Furukubo et al. | 313/639 X |
| 4,101,796 | 7/1978 | Kuus et al. | 313/558 |

FOREIGN PATENT DOCUMENTS

| | | | |
|---|---|---|---|
| 53-101874 | 9/1978 | Japan | 313/558 |
| 972613 | 11/1982 | U.S.S.R. | 313/549 |
| 1211175 | 11/1970 | United Kingdom . | |
| 1211176 | 11/1970 | United Kingdom . | |

*Primary Examiner*—Kenneth Wieder

*Attorney, Agent, or Firm*—Thomas H. Buffton; Martha Ann Finnegan

[57] ABSTRACT

An unsaturated vapor type high pressure sodium lamp includes an arc tube having a tubular ceramic envelope containing a dosing of sodium, mercury and a rare gas with an electrode sealed into each end of the envelope and an oxygen-absorbing getter telescoped over or affixed to the electrode.

10 Claims, 2 Drawing Sheets

UNSATURATED VAPOR HIGH PRESSURE SODIUM LAMP GETTER MOUNTING

This is a continuation of co-pending application Ser. No. 473,897 filed on Mar. 10, 1983, now abandoned.

CROSS REFERENCE TO OTHER APPLICATIONS

Concurrently filed applications entitled "Unsaturated Vapor Pressure Type High Pressure Sodium Lamp," bearing U.S. Ser. No. 473,895, abandoned, and "Unsaturated Vapor High Pressure Sodium Lamp Arc Tube Fabrication Process," bearing U.S. Ser. No. 473,894, abandoned, relate to an arc tube and arc tube fabricating process for unsaturated vapor high pressure sodium lamps. Also, concurrently filed applications entitled "Arc Tube Fabrication Process," bearing U.S. Ser. No. 473,896, abandoned, and "Arc Tube Dosing Process For Unsaturated High Pressure Sodium Lamps," bearing U.S. Ser. No. 473,892, abandoned relate to arc tube fabrication and arc tube dosing of unsaturated vapor type high pressure sodium lamps.

1. Techncal Field

This invention relates to unsaturated vapor high pressure sodium lamps and more particularly to the mounting of getters within the arc tube of an unsaturated vapor high pressure sodium lamp.

2. Background Art

In the field of high pressure sodium lamps, it is a common practice to provide an arc tube fill which includes a large amount of sodium and mercury in order to compensate for the undesired sodium losses encountered. These excess amounts of sodium and mercury result in an amalgam at the coolest points of the arc tube which is normally adjacent the electrodes at the ends of the arc tube. As a result, undesired variations in source voltage, color rendition and numerous other characteristics are encountered.

In an effort to eliminate or at least reduce such undesired effects, it has long been known that a lamp wherein the amount of sodium and mercury employed is only that which will become totally vaporized would provide the desired result. In other words, a high pressure sodium lamp of the unsaturated vapor type wherein sodium and mercury are introduced in only such an amount as to become totally vaporized is a highly desirable structure insofar as efficiency, cost of manufacture and enhanced lighting capability are concerned.

Also, it has long been recognized that a principal cause of undesired sodium loss in high presure sodium lamps is the presence of oxygen in the gas fill of the arc tube. One known attempt to alleviate this undesired loss of sodium due to the presence of oxygen is set forth in a concurrently filed application bearing U.S. Ser. No. 473,895, assigned to the Assignee of the present application. Therein, a getter in the form of a metal or metal alloy is located within an elongated ceramic arc tube with the metal oxides of the getter having a free energy of formation per mole of oxygen greater than that of sodium oxide. In effect, the getter reacts with free oxygen to inhibit the formation of compounds containing sodium and oxygen.

Although the above-described technique has been employed with varying amounts of success, it has been found that the results do leave something to be desired. More specifically, it has been found that intimate contact between the tubular ceramic envelope of the arc tube and the oxygen-absorbing getter therein tends to cause an undesired darkening of the ceramic envelope in the area of contact with the getter material. Although the exact cause of this darkening condition of the ceramimc envelope is not thoroughly understood, it is believed that a chemical reduction takes place between the getter and the aluminum envelope whereat contact therebetween is effected.

OBJECTS AND SUMMARY OF THE INVENTION

An object of the present invention is to provide an improved high pressure sodium lamp. Another object of the invention is to enhance the arc tube of an unsaturated vapor high pressure sodium lamp. A further object of the invention is the structure of an unsaturated vapor high pressure sodium lamp.

These and other objects, advantages and capabilities are achieved in one aspect of the invention by an arc tube having a tubular ceramic envelope with an electrode sealed into each end of the envelope, a dosing of sodium, mercury and rare gas within the envelope and an oxygen-absorbing getter attached to at least one of the electrodes within the ceramic envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
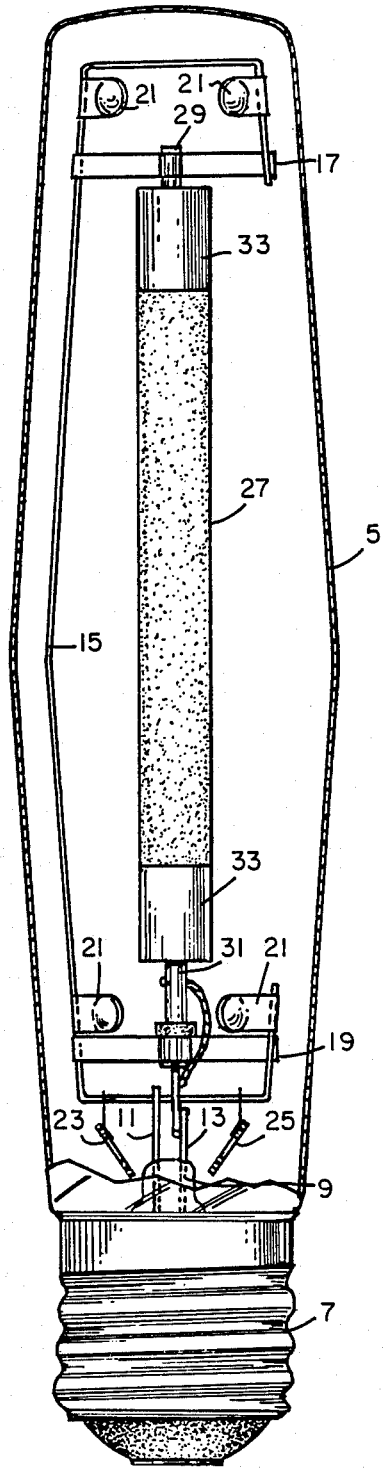
FIG. 1 is an elevational view of a preferred form of unsaturated vapor high pressure sodium lamp.

Referring to the drawings, FIG. 1 illustrates an unsaturated vapor high pressure sodium lamp having a hermetically sealed and evacuated glass envelope 5 formed to fit into an ordinary screw-type base member 7. A glass stem member 9 is sealed to the envelope 5 and projects therein. Electrical conductors, 11 and 13 respectively, are sealed into and pass through the stem member 9 to provide electrical connections from the interior to the exterior of the glass envelope 5.

An electrically conductive support member 15 is affixed to one of the electrical conductors 11 and has a pair of crossbars 17 and 19 affixed thereto at either end. Also, a plurality of spring-like members 21 are affixed to the support member 15 and formed for contact with the glass envelope 5. Moreover, a pair of getters 23 and 25 are attached to the support member 15 and serve to insure the integrity of the evacuated envelope 5.

Disposed within the glass envelope 5 and supported by the crossbars 17 and 19 is an arc tube 27. This arc tube 27, preferably of a material such as polycrystalline alumina for example, includes an electrode 29 and 31 at either end thereof. One electrode 29 is affixed to and supported by the crossbar 17 while the other electrode 31 is insulatingly supported by the other crossbar 19, but electrically connected to the electrical conductor 13 passing through the stem member 9. Heat conserving elements 33 may be wrapped about the arc tube 27 at each end thereof in the vicinity of the electrodes 29 and 31 in order to reduce the heat differential thereat from the center of the arc tube 27.

Figure 2:
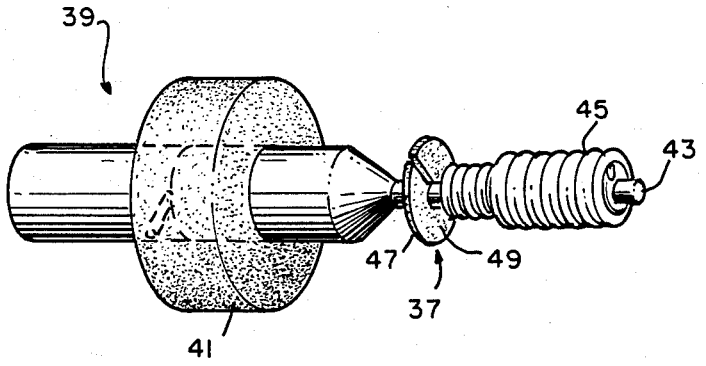
FIG. 2 is an exploded sectional view of an electrode formed for enclosure within a ceramic envelope and having an oxygen-absorbing getter affixed thereto.

Referring more specifically to FIG. 2 wherein a getter 37 is disposed within the arc tube 27 of FIG. 1, an electrode member 39 is sealed into an apertured ceramic 41 which is, in turn, sealed into the end of a tubular ceramic envelope of an arc tube. Similarly, the opposite end of the tubular ceramic envelope is sealed in substantially the same manner.

The electrode member 39 includes a shank portion 43 which has a substantially circularly-wound cathode portion 45 telescoped thereover and affixed thereto, as by welding for example. Also affixed to the shank portion 43 intermediate the cathode portion 45 and the apertured ceramic 41 is the getter 37.

Preferably, the getter 37 is in the form of a suitable substrate 47, such as nickel plated iron, and a gettering material 49, such as zirconium-aluminum powder, is sintered thereto. Therafter, the substrate 47 is affixed to or telescoped over the shank portion 43 of the electrode member 39. Although a preferred gettering material is a zirconium-aluminum alloy known as ST-101, available from SAES Getters, Milan, Italy, other metals are equally applicable. For example, metal alloys selected from the metal group consisting of aluminum, titanium, scandium, cerium, lanthanum, thorium, zirconium, yttrium and other rare earth oxides are suitable gettering materials for the above-described configurations.

Additionally, alternative methods of containing a getter material within the ceramic envelope of the arc tube and separated therefrom are appropriate. For example, a small tab containing a gettering material could be affixed to the electrode or alternatively, the getter material could be applied to the wound cathode portion 45 of the electrode member 39. Obviously, other configurations of a similar nature are appropriate to the structure so long as the gettering material is separated from the ceramic envelope of the arc tube.

While there has been shown and described what is at present considered the preferred embodiments of the invention, it will be obvious to those skilled in the art that various changes and modifications may be made therein without departing from the invention as defined by the appended claims.

What is claimed is:

1. In a high pressure sodium lamp of the unsaturated vapor type, an arc tube comprising:
   - a tubular ceramic envelope;
   - a dosing of sodium, mercury and a rare gas within said ceramic envelope;
   - an electrode sealed into each end of said ceramic envelope; and
   - an oxygen-absorbing getter located within said ceramic envelope and in contact with said dosing and contiguous to at least one of said electrodes.

2. The arc tube of claim 1 wherein said oxygen-absorbing getter is located within and spaced from the inner surface of said tubular ceramic envelope.

3. The arc tube of claim 1 wherein said oxygen-absorbing getter is affixed to a substrate which is affixed to one of said electrodes within said tubular ceramic envelope.

4. The arc tube of claim 1 wherein said oxygen-absorbing getter is in the form of a metal powder sintered onto a substrate attached to one of said pair of electrodes within said tubular ceramic envelope.

5. The arc tube of claim 1 wherein said oxygen-absorbing getter selected from a group consisting of aluminum, titanium, scandium, hafnium, cerium, lanthanum, thorium, yttrium and zirconium.

6. The arc tube of claim 1 wherein sodium and mercury of said dosing within said tubular envelope are in the form of an amalgam decomposable within said lamp to provide said mercury and said sodium and oxygen which is absorbed by said oxygen-absorbing getter.

7. The arc tube of claim 1 wherein said tubular ceramic envelope is in the form of a tubular polycrystalline aluminum envelope.

8. In an unsaturated type high pressure sodium lamp having a tubular ceramic envelope containing a dosing of sodium, mercury and rare gas with an electrode member sealed into each end of the tubular ceramic envelope, the improvement comprising an oxygen-absorbing getter affixed to at least one of said electrode members within said ceramic envelope.

9. The improvement of claim 8 wherein said oxygen-absorbing getter is spaced from the inner wall surface of said tubular ceramic envelope.

10. The improvement of claim 8 wherein said oxygen-absorbing getter is in the form of a zirconium-aluminum alloy sintered to a substrate and contiguous to at least one of said electrode members.

* * * * *